US008210819B2

(12) United States Patent
Wiebe et al.

(10) Patent No.: US 8,210,819 B2
(45) Date of Patent: Jul. 3, 2012

(54) AIRFOIL STRUCTURE SHIM

(75) Inventors: David J Wiebe, Orlando, FL (US); John W Finneran, Palm Beach Gardens, FL (US); Jeffery W Samuelson, Jupiter, FL (US); Richard C Charron, West Palm Beach, FL (US)

(73) Assignee: Siemens Energy, Inc., Orlando, FL (US)

( * ) Notice: Subject to any disclaimer, the term of this patent is extended or adjusted under 35 U.S.C. 154(b) by 1154 days.

(21) Appl. No.: 12/035,495

(22) Filed: Feb. 22, 2008

(65) Prior Publication Data

US 2009/0214349 A1 Aug. 27, 2009

(51) Int. Cl.
*F04D 29/34* (2006.01)

(52) U.S. Cl. ..... 416/218

(58) Field of Classification Search ..... 416/220 R, 416/221, 248, 215, 216, 217, 218
See application file for complete search history.

(56) References Cited

U.S. PATENT DOCUMENTS 2,686,656 A * 8/1954 Abild ..... 416/221
2,825,530 A * 3/1958 Schum et al. ..... 416/92
3,809,495 A * 5/1974 Stahl ..... 416/135
3,836,282 A * 9/1974 Mandelbaum et al. .... 415/209.4
4,505,640 A * 3/1985 Hsing et al. ..... 416/97 R
4,563,128 A 1/1986 Rossmann
4,722,184 A 2/1988 Chaplin et al.
5,100,292 A * 3/1992 Matula et al. ..... 416/220 R
6,151,950 A * 11/2000 Wilhelm et al. ..... 72/409.01
6,202,273 B1 3/2001 Watts
6,273,683 B1 8/2001 Zagar et al.
6,290,466 B1 9/2001 Ravenhall et al.
6,431,835 B1 8/2002 Kolodziej et al.
6,533,544 B1 3/2003 Tiemann et al.
6,619,924 B2 9/2003 Miller
6,860,722 B2 3/2005 Forrester et al.
6,984,108 B2 1/2006 Anderson et al.
7,137,997 B2 * 11/2006 Paul ..... 623/17.11
7,264,448 B2 9/2007 Garner
7,854,583 B2 * 12/2010 Wichmann et al. ..... 415/1
2004/0062652 A1 * 4/2004 Grant et al. ..... 416/220 R
2004/0244948 A1 * 12/2004 Luo ..... 165/80.3

* cited by examiner

*Primary Examiner* — Edward Look
*Assistant Examiner* — Adam Benson

(57) ABSTRACT

An airfoil structure, shim, and retention member combination includes an airfoil structure, a retention member and a shim. The airfoil structure may define a first recess. The retention member may define a second recess. The first and second recesses may define a cavity. The shim may include a main body and a plurality of first fins extending outwardly from a first side of the main body. The first fins may further extend transverse to a longitudinal axis of the main body. The shim may be positioned in the cavity such that the first fins extend in a direction substantially transverse to a longitudinal axis of the cavity.

20 Claims, 5 Drawing Sheets

AIRFOIL STRUCTURE SHIM

FIELD OF THE INVENTION

The present invention is directed to a shim to be received in a cavity defined by a first recess in an airfoil structure and a second recess in a retention member and, further, is directed to an airfoil structure, shim and retention member combination.

BACKGROUND OF THE INVENTION

A conventional combustible gas turbine engine includes a compressor, a combustor, and a turbine. The compressor compresses ambient air. The combustor combines the compressed air with a fuel and ignites the mixture creating combustion products defining a working gas. The working gases travel to the turbine. Within the compressor are a series of rows of stationary vanes and rotating blades. Each pair of rows of vanes and blades is called a stage. The rotating blades are coupled to a shaft and rotor disc assembly.

For each row of blades, a separate rotor disc is provided. The rotor discs form part of the shaft and rotor disc assembly. One or more of the rotor discs is provided with a dovetail slot extending 360 degrees about the disc so as to receive dovetail bases or roots of blades. For each row of vanes, a retention casing fixedly coupled to a housing of the gas turbine engine is provided. One or more of the retention casings is provided with a dovetail slot so as to receive dovetail bases or roots of vanes.

In order to frictionally hold a root of a blade in the dovetail slot, a solid shim is provided within a cavity defined by recesses in the blade root and the rotor disc. Similarly, in order to frictionally maintain a root of a vane in a dovetail slot, a shim is provided within a cavity defined by recesses in the vane root and the retention casing. If, for example, a range of cavity sizes varies, due to tolerances, from 15.00 mm to 15.30 mm and a minimum allowable gap within the cavity is 0.05 mm, a plurality of solid shims would need to be available during assembly of the blades with the rotor discs and the vanes with the retention casings, with each solid shim corresponding to a particular cavity size. For example, six shim height sizes (15.00 mm; 15.05 mm; 15.10 mm; 15.15 mm; 15.20 mm; and 15.25 mm) would be needed for the cavity size tolerance range of 15.00 mm to 15.30 mm. Hence, during assembly of a blade in its dovetail slot, a solid shim of an appropriate size would be selected from the six available sizes and inserted into the recess. Likewise, during assembly of a vane in its dovetail slot, a solid shim of an appropriate size selected from the six available sizes would be selected and inserted into the recess.

Instead of a solid shim, a thin wave-shaped spring shim may be provided. Such a shim is disadvantageous because it is susceptible to loosing its spring force, allowing relative motion of a corresponding blade or vain resulting in wear.

SUMMARY OF THE INVENTION

In accordance with a first aspect of the present invention, a shim is provided which is adapted to be received in a cavity defined by a first recess in an airfoil structure and a second recess in a retention member. The shim comprises a main body and a plurality of first fins extending outwardly from a first side of the main body and a plurality of second fins extending outwardly from a second side of the main body.

In a first embodiment, each of the first and second fins may have a width of from about 0.5 mm to about 3 mm and a height of from about 0.5 mm to about 3.0 mm. In a second embodiment, each of the first and second fins may have a width of from about 1 mm to about 3 mm and a height of from about 1.5 mm to about 6 mm.

The main body may have height of from about 2 mm to about 15 mm, a width of from about 2 mm to about 20 mm, and a length of from about 8 mm to about 200 mm.

The first and second fins may extend in an axial direction of the retention member.

In one embodiment, the airfoil structure may comprise a blade and the retention member may comprise a rotor disk. In a further embodiment, the airfoil structure may comprise a vane and the retention member may comprise a retention casing.

The second side of the main body may be transverse to the main body first side.

The main body of the shim may have a length along a first axis and the first fins may have a length along that same first axis, wherein the length of the main body along the first axis is greater than the length of the first fins along the first axis.

In accordance with a second aspect of the present invention, an airfoil structure, shim and retention member combination is provided. The combination comprises an airfoil structure, a retention member and a shim. The airfoil structure may comprise a first recess. The retention member may comprising a second recess. The first and second recesses may define a cavity. The shim may comprise a main body and a plurality of first fins extending outwardly from a first side of the main body. The first fins may further extend transverse to a longitudinal axis of the main body. The shim may be positioned in the cavity such that the first fins extend in a direction substantially transverse to a longitudinal axis of the cavity.

The shim may further comprise a plurality of second fins extending outwardly from a second side of the main body, which is transverse to the main body first side. In one embodiment, each of the first and second fins may have a width of from about 0.5 mm to about 3 mm and a height of from about 0.5 mm to about 3 mm. In another embodiment, each of the first and second fins may have a width of from about 1 mm to about 3 mm and a height of from about 1.5 mm to about 6 mm.

DETAILED DESCRIPTION OF THE INVENTION

Figure 1:
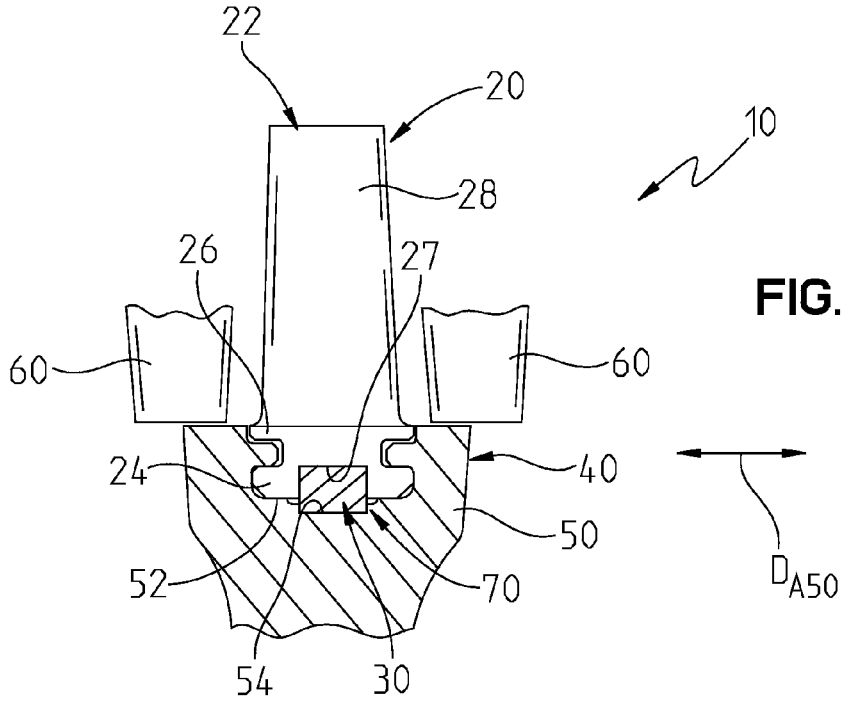
FIG. 1 is a view, partially in cross section, of an airfoil structure/shim/retention member combination constructed in accordance with a first embodiment of the present invention.

In FIG. 1, an airfoil structure/shim/retention member combination 10 constructed in accordance with a first embodiment of the present invention is illustrated. The airfoil structure/shim/retention member combination 10 is adapted to be used in a gas turbine (not shown) of a gas turbine engine (not shown). The gas turbine engine may include a compressor (not shown), a combustor (not shown), and a turbine (not shown). The compressor compresses ambient air. The combustor combines the compressed air with a fuel and ignites the mixture creating combustion products defining a working gas. The working gases travel to the turbine. Within the compressor are a series of rows of stationary vanes and rotating blades. Each pair of rows of vanes and blades is called a stage. For each row of blades, a separate rotor disc is provided. The rotor discs form part of a shaft and rotor disc assembly. One or more of the rotor discs is provided with a dovetail slot extending 360 degrees about the disc so as to receive dovetail bases or roots of blades. For each row of vanes, a retention casing fixedly coupled to a housing of the gas turbine engine is provided. One or more of the retention casings is provided with a dovetail slot so as to receive dovetail bases or roots of vanes.

In the FIG. 1 embodiment, the airfoil structure/shim/retention member combination 10 comprises an airfoil structure 20, a shim 30 and a retention member 40. The retention member 40 comprises a rotor disc 50, which is coupled to the turbine shaft (not shown) and forms part of the shaft and rotor disc assembly. The rotor disc 50 is provided with a dovetail slot 52 that extends 360 degrees about the disc 50. At a base of the dovetail slot 52 is provided a recess 54.

The airfoil structure 20 comprises a blade 22 having a dovetail root or base 24, a platform 26 and an exposed blade portion 28. The dovetail base 24 is 5 provided with a recess 27. As noted above, the rotor disc 50 is provided with a dovetail slot 52. The rotor disc dovetail slot 52 is adapted to receive the dovetail base 24 of the blade 22. The blade dovetail base 24 functions to couple the blade 22 to the rotor disc 50 when received in the slot 52. When the blade dovetail base 24 is positioned in the rotor disc dovetail slot 52, the recess 27 in the base 24 becomes aligned with and is located opposite the recess 54 in the base of the dovetail slot 52. The two aligned recesses 27 and 54 define a cavity 70. As illustrated in FIG. 1, stationary vanes 60 are located on opposing sides of the blade 22.

Figure 3:
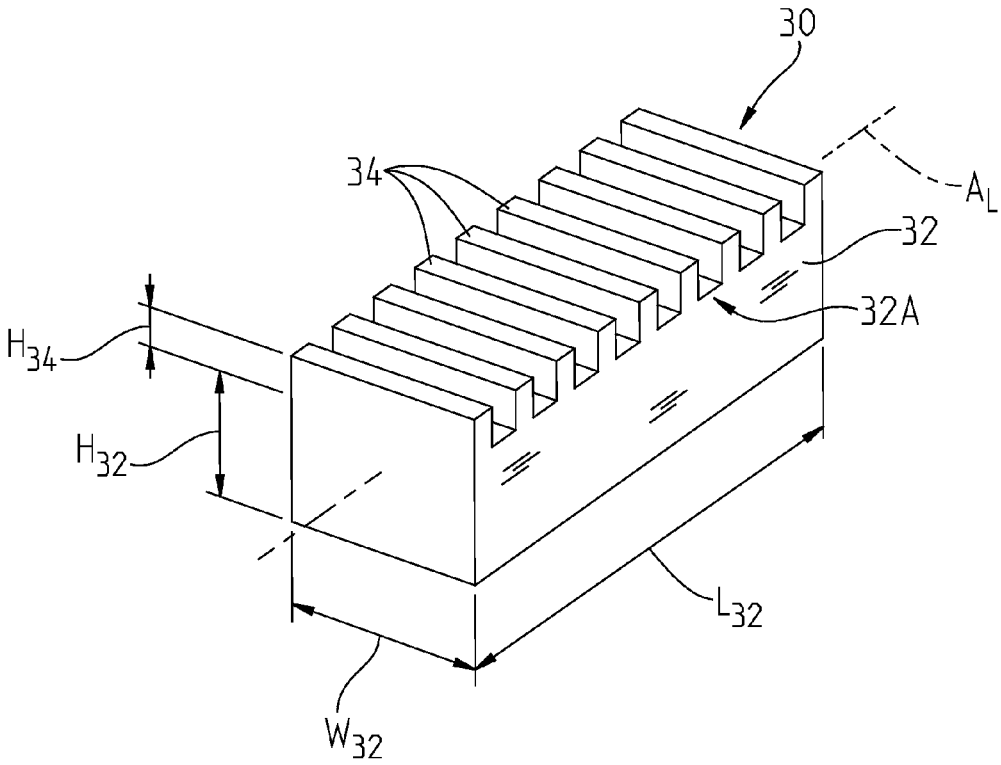
FIG. 3 is a perspective view of the shim illustrated in FIG. 1.

The shim 30 comprise a main body 32 and a plurality of fins 34 extending outwardly from a first side 32A of the main body 32, see FIG. 3. The main body 32 may have height $H_{32}$ of from about 2 mm to about 15 mm, a width $W_{32}$ of from about 2 mm to about 20 mm, and a length $L_{32}$ of from about 8 mm to about 200 mm. The fins 34 extend transverse to a longitudinal axis $A_L$ of the main body 32. In the illustrated embodiment, the fins 34 extend at an angle of about 90 degrees to the longitudinal axis $A_L$ of the main body 32. However, it is contemplated that the fins 34 may extend at any angle falling within a range of from about 45 degrees to about 105 degrees to the longitudinal axis $A_L$ of the main body 32.

Figure 4:
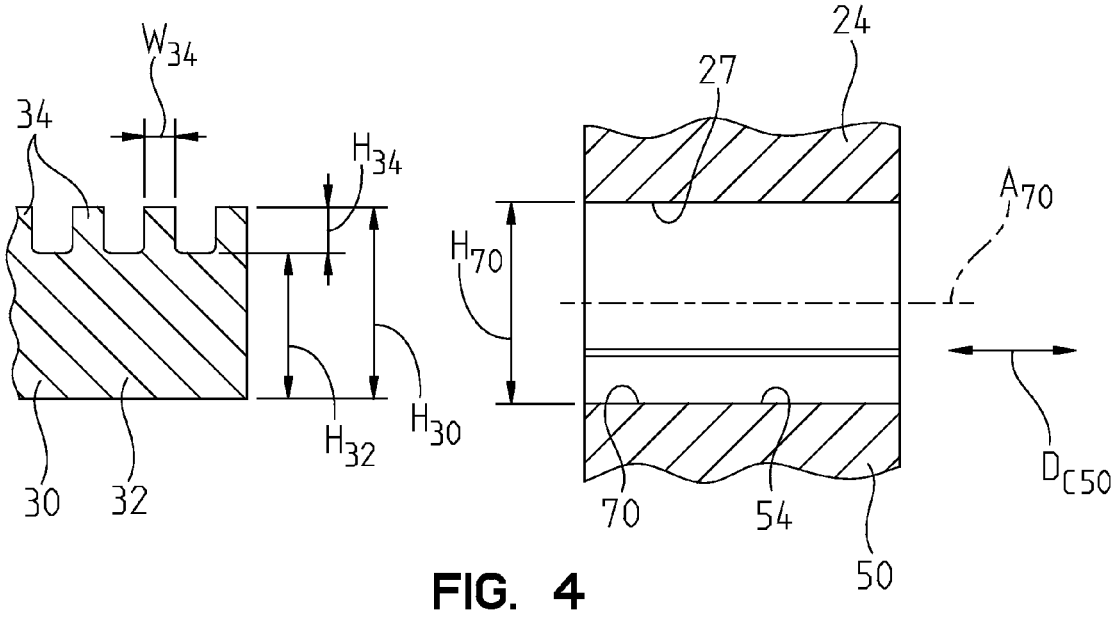
FIG. 4 is a side view, in cross section, of an airfoil structure/shim/retention member combination constructed in accordance with a first embodiment of the present invention prior to the shim being inserted into a cavity defined between the airfoil structure and the retention member.

In a first embodiment, each of the fins 34 may have a width $W_{34}$ of from about 0.5 mm to about 3 mm and a height $H_{34}$ of from about 0.5 mm to about 3 mm, see FIGS. 3 and 4. Hence, in the first embodiment, the overall height $H_{30}$ of the shim 30 may be between about 2.5 mm and 18 mm. In a second embodiment, each of the fins 34 may have a width $W_{34}$ of from about 1 mm to about 3 mm and a height $H_{34}$ of from about 1.5 mm to about 6 mm. Hence, in the second embodiment, the overall height $H_{30}$ of the shim 30 may be between about 3.5 mm and 21 mm. In both embodiments, the height $H_{32}$ of the main body 32 of the shim 32 is preferably greater than the $H_{34}$ of the fins 34.

Figure 5:
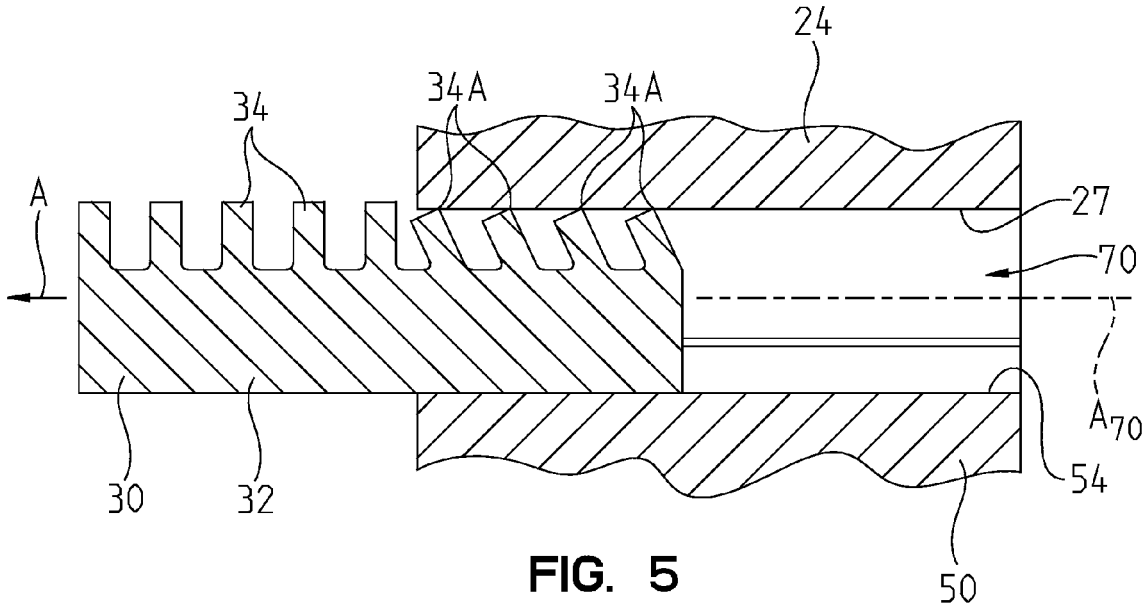
FIG. 5 is a side view, in cross section, illustrating a shim being inserted into a cavity defined between an airfoil structure and retention member.

After the blade base 24 has been inserted into the dovetail slot 52, the shim 30 is inserted into the cavity 70 defined by the two aligned recesses 27 and 54 in the blade base 24 and the rotor disc dovetail slot 52 so as to frictionally hold or immobilize the dovetail base 24 of the blade 22 in the dovetail slot 52 in the rotor disc 50, i.e., prevent the blade 22 from dithering, rocking, sliding or otherwise moving in the slot 52. A spacer, not shown, may be inserted into the slot 52 between each blade 22. The longitudinal axis $A_L$ of the shim 30 extends in a circumferential direction $D_{C50}$, see FIG. 4, of the rotor disc 50, wherein the rotor disc circumferential direction extends in and out of the plane of FIG. 1. As is apparent from FIGS. 4 and 5, once the shim 30 is positioned within the cavity 70, the fins 34 extend transverse to a longitudinal axis $A_{70}$ of the cavity 70. The fins 34 also extend transverse to the circumferential direction of the rotor disc 50 and parallel to an axial direction $D_{A50}$, see FIG. 1, of the rotor disc 50. If a height $H_{70}$ of the cavity 70 is less than the overall height $H_{30}$ of the shim 30, see FIG. 4, the fins 34 either deform at an angle, see FIG. 5, compress (not shown), shear off (not shown) or deform in another manner when the shim 30 is inserted into the cavity 70. The longer fins of the second embodiment are more likely to deform at an angle as compared to the shorter fins of the first embodiment. If the fins 34 are deformed at an angle during the assembly operation, edges 34A of the fins 34 function to lock the shim 30 in position within the cavity 70 so as to resist movement of the shim 30 in a direction indicated by arrow A in FIG. 5.

The shim 30 of the present invention is capable of being used during assembly of blades 22 in the slot 52 of a rotor disc 50 where the cavities 70 defined by aligned recesses 27 and 54 fall within a fairly broad range of sizes, due to tolerances. For example, if the range of cavity sizes varies, due to tolerances, from 15.00 mm to 15.30 mm and a minimum allowable gap (the distance between the shim 30 and the rotor disc 50, the distance between the shim 30 and the blade 22 or a combined distance between the shim 30 and the rotor disc 50 and the shim 30 and the blade 22) within the cavity 70 is equal to or less than 0.05 mm, a shim 30 having an overall height $H_{30}$ failing within a range of from about 2.5 mm to about 21 mm may be used. For example, a shim 30 having an overall height $H_{30}$ equal to 15.25 mm may be provided. Hence, if the cavity size is 15.00 mm, the shim fins 34 will either deform or be sheared off by an amount equal to about 0.25 mm. Alternatively, if the cavity size is 15.30 mm, the gap within the cavity will only be 0.05 mm, which is within the acceptable minimum allowable gap range.

Figure 2:
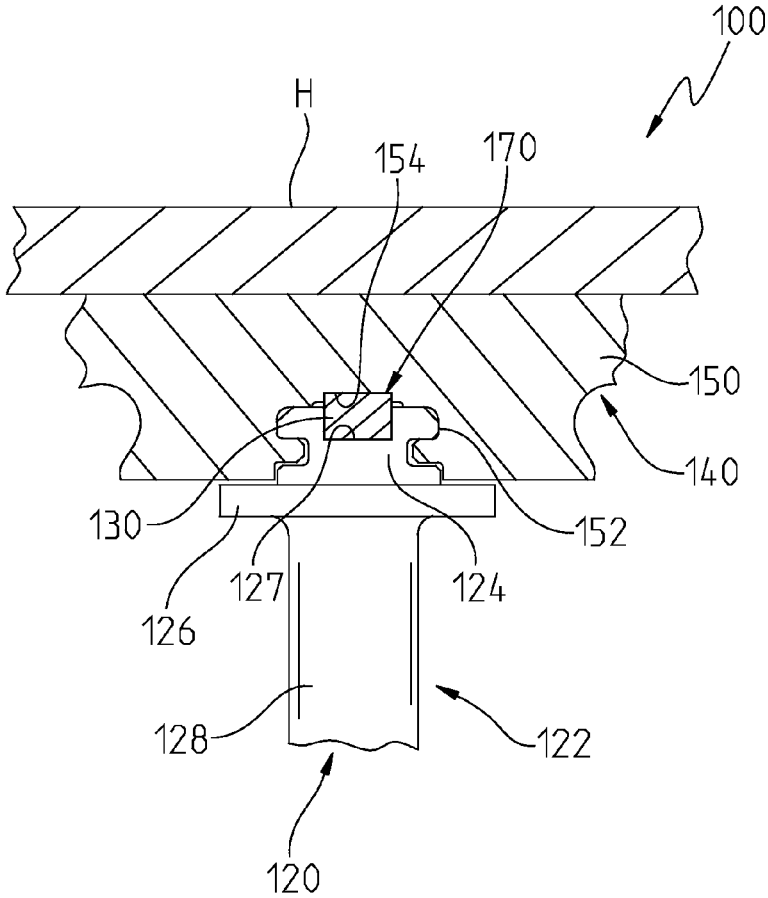
FIG. 2 is a view, partially in cross section, of an airfoil structure/shim/retention member combination constructed in accordance with a second embodiment of the present invention.

In FIG. 2, an airfoil structure/shim/retention member combination 100 constructed in accordance with a second embodiment of the present invention is illustrated. The airfoil structure/shim/retention member combination 100 comprises an airfoil structure 120, a shim 130 and a retention member 140. The retention member 140 comprises a retention casing 150 fixedly coupled to a housing H of the gas turbine engine. The retention casing 150 is provided with a dovetail slot 152 extending 360 degrees about the retention casing 150. At a base of the dovetail slot 152, a recess 154 is provided.

The airfoil structure 120 comprises a vane 122 having a dovetail root or base 124, a platform 126 and an exposed blade portion 128. The dovetail base 124 is provided with a recess 127. As noted above, the retention casing 150 is provided with a dovetail slot 152. The retention casing dovetail slot 152 is adapted to receive a dovetail base 124 of a vane 122. The vane dovetail base 124 functions to couple the vane 122 to the retention casing 150 when received in the slot 152. When the vane dovetail base 124 is positioned in the retention casing dovetail slot 152, the recess 127 in the vane dovetail base 124 becomes aligned with and is located opposite the recess 154 in the base of the dovetail slot 152. The two aligned recesses 127 and 154 define a cavity 170.

Figure 6:
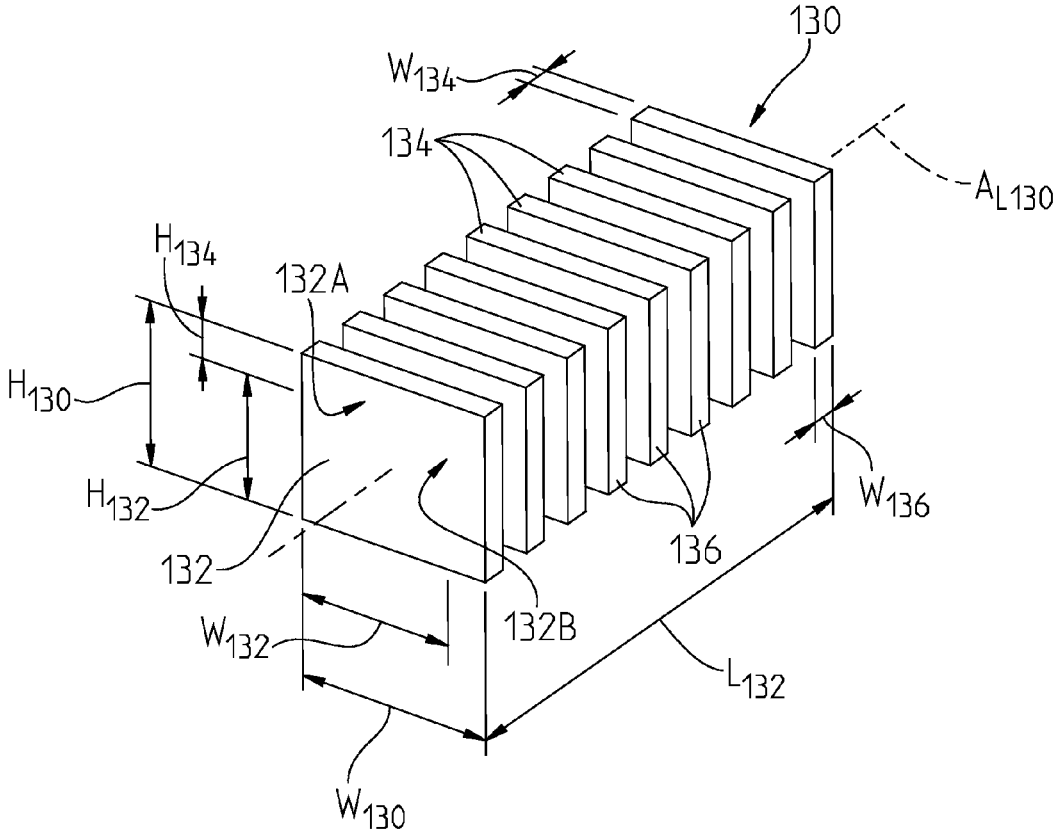
FIG. 6 is a perspective view of the shim illustrated in FIG. 2.

The shim 130 comprise a main body 132 and a plurality of first fins 134 extending outwardly from a first side 132A of the main body 132 and a plurality of second fins 136 extending outwardly from a second side 132B of the main body 132, see FIG. 6. The main body 132 may have height $H_{132}$ of from about 2 mm to about 15 mm, a width $W_{132}$ of from about 2 mm to about 20 mm, and a length $L_{132}$ of from about 8 mm to about 200 mm, see FIG. 6. The first and second fins 34 extend transverse to a longitudinal axis $A_{L130}$ of the main body 132.

Figure 7:
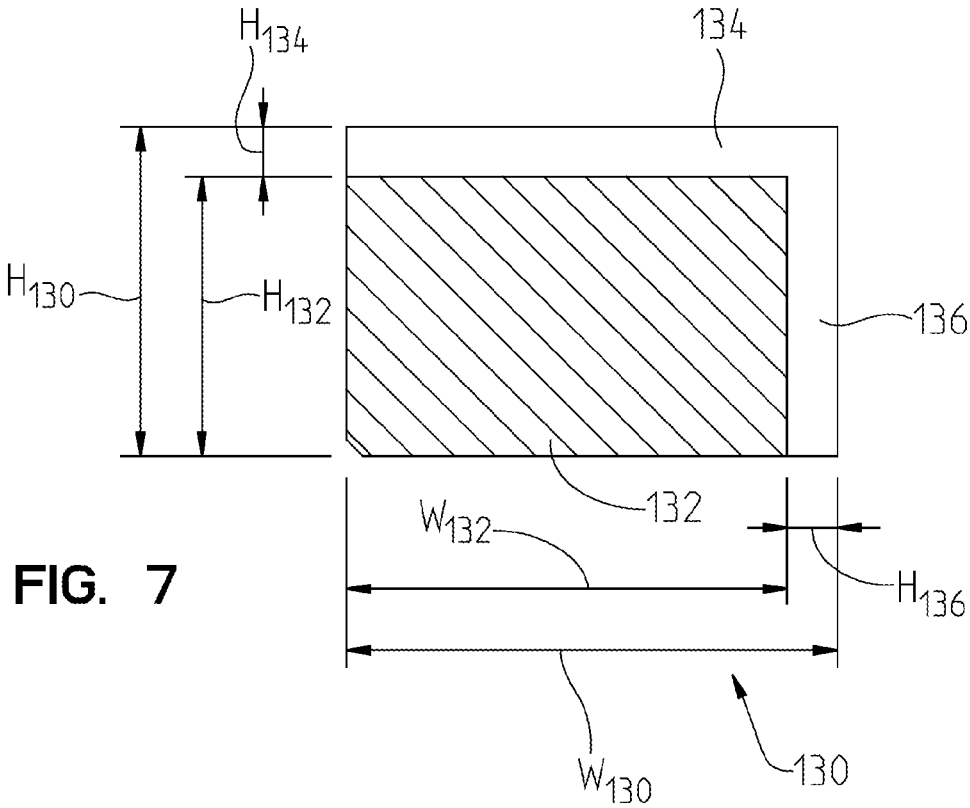
FIG. 7 is a view, partially in cross section, of the shim illustrated in FIG. 6.
Figure 8:
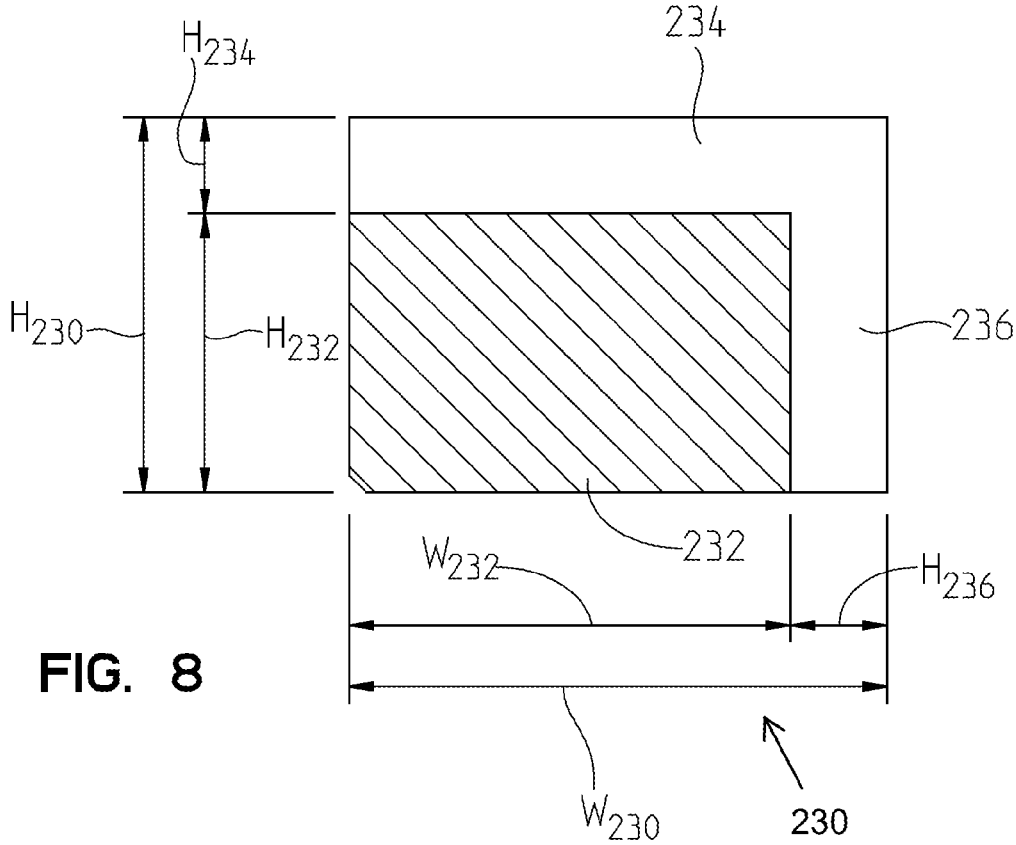
FIG. 8 is a view, partially in cross section, of a shim having first and second fins constructed in accordance with an alternative embodiment of the present invention.

In a first embodiment, each of the first fins 134 may have a width $W_{134}$ of from about 0.5 mm to about 3 mm and a height $H_{134}$ of from about 0.5 mm to about 3 mm and each of the second fins 136 may have a width $W_{136}$ of from about 0.5 mm to about 3 mm and a height $H_{136}$ of from about 0.5 mm to about 3 mm, see FIGS. 6 and 7. Hence, in the first embodiment, the overall height $H_{130}$ of the shim 130 may be between about 2.5 mm and 18 mm and the overall dimension of the shim 130 comprising the width $W_{132}$ of the main body 132 together with the height $H_{136}$ of the second fins 136 may be between about 2.5 mm and 23 mm. In a second embodiment, each of the first fins 234 may have a width (not shown) of from about 1 mm to about 3 mm and a height $H_{234}$ of from about 1.5 mm to about 6 mm and each of the second fins 236 may have a width (not shown) of from about 1 mm to about 3 mm and a height $H_{236}$ of from about 1.5 mm to about 6 mm, see FIG. 8. Hence, in the second embodiment, the overall height $H_{230}$ of the shim 230 comprising the height $H_{232}$ of the main body 232 together with the height $H_{234}$ of the first fins 234 may be between about 3.5 mm and 21 mm and the overall dimension $W_{230}$ of the shim 230 comprising the width $W_{232}$ of the main body 232 together with the height $H_{236}$ of the second fins 236 may be between about 3.5 mm and 26 mm.

The shim 130 is inserted into the cavity 170 defined by the two aligned recesses 127 and 154 in the vane base 124 and the retention casing slot 152 so as to frictionally hold the dovetail base 124 of the vane 122 in the dovetail slot 152 in the retention casing 150. In the FIG. 2 embodiment, the longitudinal axis $A_{L130}$ of the shim 130 extends in a circumferential direction of the retention casing 150. The first and second fins 134 and 136 extend transverse to a longitudinal axis of the cavity 170, transverse to the circumferential direction of the retention casing 150 and parallel to an axial direction of the retention casing 150. If a height of the cavity 170 (in a radial direction of the retention casing 150) is less than the overall height $H_{130}$ of the shim 130, the first fins 134 either deform at an angle, compress, shear off or deform in another manner when the shim 130 is inserted into the cavity 170. In a similar manner, if a width of the cavity 170 (in an axial direction of the retention casing 150) is less than the overall dimension $W_{130}$ of the shim 130 comprising the width $W_{132}$ of the main body 132 together with the height $H_{136}$ of the second fins 136, then the second fins 136 either deform at an angle, compress, shear off or deform in another manner when the shim 130 is inserted into the cavity 170.

Figure 9:
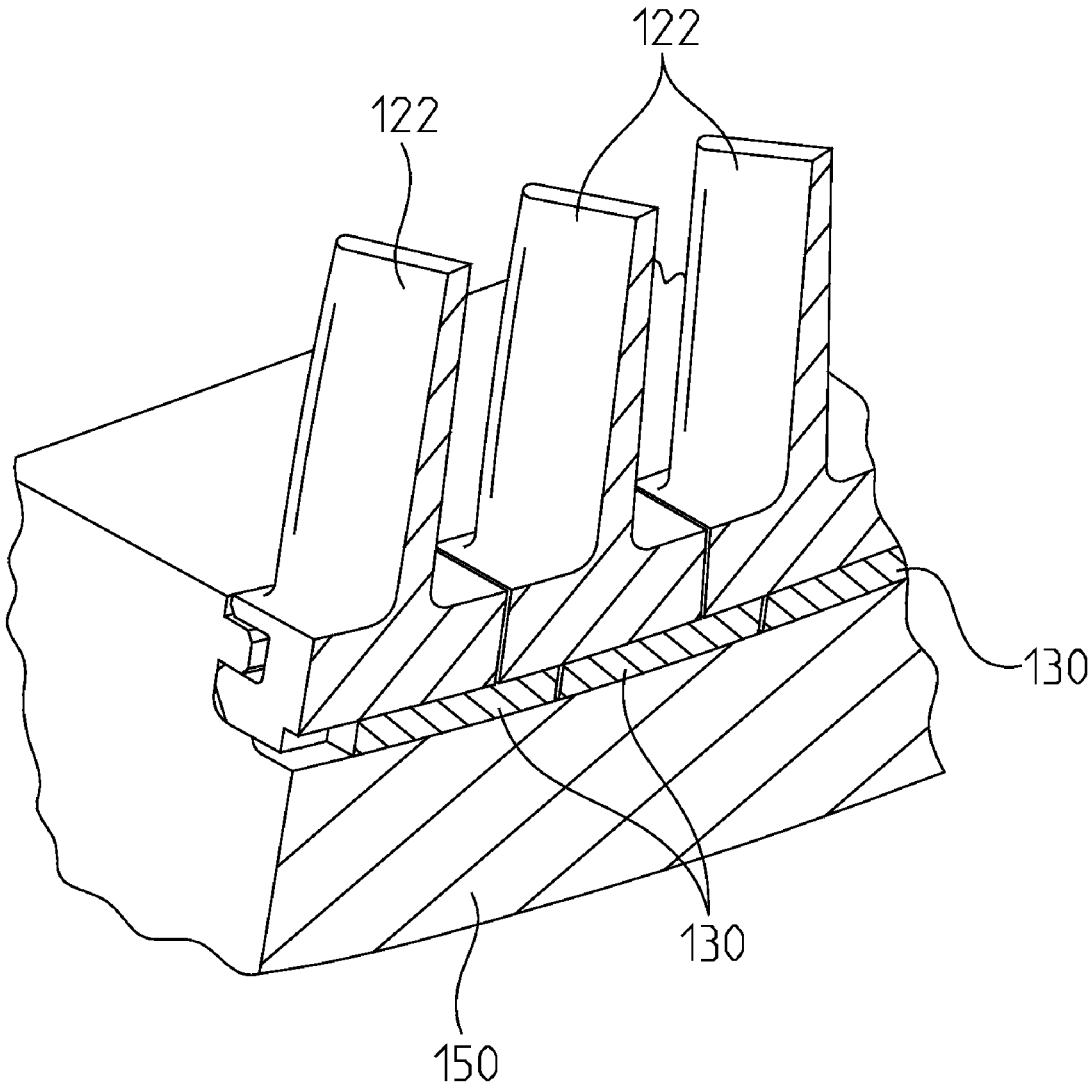
FIG. 9 is a view, partially in cross section, showing a plurality of shims, each of which extends between two vanes.

In an embodiment illustrated in FIG. 9, shims 130 are provided having a length such that they extend between two vanes 122. Each shim 30, 130, 230 of the present invention may have length equal to, less than or greater than a length of a single blade or vane.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shim adapted to be received in a cavity defined by a first recess in an airfoil structure and a second recess in a retention member, said shim comprising:

a main body; and a plurality of first fins extending outwardly from a first side of said main body in a direction toward said airfoil structure and away from said retention member and a plurality of second fins extending outwardly from a second side of said main body.

2. The shim of claim 1, wherein each of said first fins has a width of from about 0.5 mm to about 3 mm and a height of from about 0.5 mm to about 3.0 mm.

3. The shim of claim 2, wherein said main body has a height of from about 2 mm to about 15 mm.

4. The shim of claim 1, wherein each of said first fins has a width of from about 1 mm to about 3 mm and a height of from about 1.5 mm to about 6 mm.

5. The shim of claim 1, wherein said main body has a height of from about 2 mm to about 15 mm.

6. The shim of claim 1, wherein said airfoil structure comprises a blade and said retention member comprises a rotor disk.

7. The shim of claim 1, wherein said airfoil structure comprises a vane and said retention member comprises a retention casing.

8. The shim of claim 1, wherein said second side of said main body is transverse to said main body first side.

9. The shim of claim 8, wherein said main body of said shim has a length along a first axis and said first fins have a length along the first axis, wherein the length of said main body along the first axis is greater than the length of said first fins along the first axis.

10. The shim of claim 1, wherein ends of said first fins opposed from said main body engage a radially inner surface of said airfoil structure.

11. An airfoil structure, shim, and retention member combination comprising:

an airfoil structure including a first recess;

a retention member comprising a second recess, said first and second recesses defining a cavity; and a shim comprising a main body and a plurality of first fins extending outwardly from a first side of said main body in a direction toward said airfoil structure and away from said retention member and further extending transverse to a longitudinal axis of said main body, said shim being positioned in said cavity such that said first fins extend in a direction substantially transverse to a longitudinal axis of said cavity.

12. The combination of claim 11, wherein each of said first fins has a width of from about 0.5 mm to about 3 mm and a height of from about 0.5 mm to about 3 mm.

13. The combination of claim 11, wherein each of said first fins has a width of from about 1 mm to about 3 mm and a height of from about 1.5 mm to about 6 mm.

14. The combination of claim 11, wherein said first fins extend in an axial direction of said retention member.

15. The combination of claim 11, wherein said airfoil structure comprises a blade and said retention member comprises a rotor disk.

16. The combination of claim 11, wherein said airfoil structure comprises a vane and said retention member comprises a retention casing.

17. The combination of claim 11, wherein said shim further comprising a plurality of second fins extending outwardly from a second side of said main body, which is transverse to said main body first side.

18. The combination of claim 17, wherein each of said second fins has a width of from about 0.5 mm to about 3 mm and a height of from about 0.5 mm to about 3 mm.

19. The combination of claim 17, wherein each of said second fins has a width of from about 1 mm to about 3 mm and a height of from about 1.5 mm to about 6 mm.

20. The combination of claim 11, wherein ends of said first fins opposed from said main body engage a radially inner surface of said airfoil structure.

* * * * *